US008128309B2

(12) United States Patent
Tsai

(10) Patent No.: US 8,128,309 B2
(45) Date of Patent: Mar. 6, 2012

(54) LIFTING DEVICE FOR THE BACKREST OF A CHAIR

(76) Inventor: Po-Chuan Tsai, Tainan Hsien (TW)

( * ) Notice: Subject to any disclaimer, the term of this patent is extended or adjusted under 35 U.S.C. 154(b) by 248 days.

(21) Appl. No.: 12/577,934

(22) Filed: Oct. 13, 2009

(65) Prior Publication Data

US 2011/0085851 A1 Apr. 14, 2011

(51) Int. Cl.
*A47C 7/54* (2006.01)

(52) U.S. Cl. ..... 403/322.1; 297/411.36

(58) Field of Classification Search ..... 403/322.1, 403/327, 328, 105–108; 297/353, 411.36, 297/410; 384/58, 19
See application file for complete search history.

(56) References Cited

U.S. PATENT DOCUMENTS 5,588,766 A * 12/1996 Lai ..... 403/105
5,620,233 A * 4/1997 Corwin ..... 297/411.36
5,649,741 A * 7/1997 Beggs ..... 297/353
5,695,249 A * 12/1997 Lotfi ..... 297/353
5,735,577 A * 4/1998 Lin ..... 297/411.36
5,765,920 A * 6/1998 Lai ..... 297/411.36
6,264,276 B1 * 7/2001 Chen ..... 297/353
6,299,253 B1 * 10/2001 Chen ..... 297/353
6,631,953 B2 * 10/2003 Lai ..... 297/353
6,709,059 B1 * 3/2004 Cvek ..... 297/353
7,188,901 B2 * 3/2007 Helmond et al. ..... 297/353
7,243,997 B1 * 7/2007 Tornero ..... 297/411.37
7,360,837 B1 * 4/2008 Liu ..... 297/353

* cited by examiner

*Primary Examiner* — Joshua Kennedy
(74) *Attorney, Agent, or Firm* — Alan Kamrath; Kamrath IP Lawfirm, PA

(57) ABSTRACT

A lifting device for the backrest of a chair includes a fixed member, a movable member movably mounted on the fixed member and having an elongate slideway and a plurality of locking grooves, a locking bolt extending into the slideway of the movable member and detachably locked in one of the locking grooves of the movable member, a slide secured on the locking bolt to move the locking bolt, and an elastic member biased between the slide and the fixed member to push the locking bolt toward one of the locking grooves. Thus, the movable member is moved relative to the fixed member to adjust the height of the backrest so that the height of the backrest can be adjusted according to a user's requirement, and the backrest can support the user's back efficiently.

16 Claims, 14 Drawing Sheets

LIFTING DEVICE FOR THE BACKREST OF A CHAIR

BACKGROUND OF THE INVENTION

1. Field of the Invention

The present invention relates to a lifting device and, more particularly, to a lifting device for lifting and lowering the backrest of a chair so as to adjust the height of the backrest.

2. Description of the Related Art

A conventional chair comprises a support base, a seat mounted on the support base, a substantially L-shaped backrest support mounted on the support base, and a backrest mounted on the backrest support and located above the seat. The backrest support can be pivoted relative to the support base to move the backrest so as to adjust the inclined angle of the backrest relative to the seat. However, the backrest has a fixed height so that the height of the backrest cannot be adjusted according to a user's requirement, thereby easily causing an uncomfortable sensation to the user.

BRIEF SUMMARY OF THE INVENTION

In accordance with the present invention, there is provided a lifting device, comprising a fixed member, a movable member movably mounted on the fixed member and having an elongate slideway, a plurality of locking grooves each connected to the slideway and an elongate guide slot parallel with the slideway, a locking bolt extending into the slideway of the movable member and detachably locked in one of the locking grooves of the movable member, a slide slidably mounted on the fixed member and secured on the locking bolt to move the locking bolt relative to the movable member, an elastic member biased between the slide and the fixed member to push the slide and the locking bolt toward one of the locking grooves of the movable member, and a limit bolt movably mounted on the fixed member and extending into the guide slot of the movable member. The lifting device further comprises a positioning member secured on the limit bolt to move in concert with the limit bolt and having a substantially inverted L-shaped locking slot that is movable to detachably lock the locking bolt. The lifting device further comprises at least one roller rotatably mounted on the fixed member and slidably abutting the movable member to facilitate movement of the movable member relative to the fixed member.

The primary objective of the present invention is to provide a lifting device that can adjust the height of the backrest of a chair.

According to the primary objective of the present invention, the movable member is moved relative to the fixed member to adjust the height of the backrest of the chair so that the height of the backrest can be adjusted according to a user's requirement, and the backrest can support the user's back efficiently, thereby providing a comfortable sensation to the user.

According to another objective of the present invention, the at least one roller is rotatably mounted between the fixed member and the movable member to facilitate movement of the movable member relative to the fixed member.

According to a further objective of the present invention, the positioning member has a corrugated second contact face slidably contacting with the corrugated first contact face of the fixed member, and a buffering space is defined between the positioning member and the second contact face so as to facilitate movement of the positioning member relative to the fixed member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
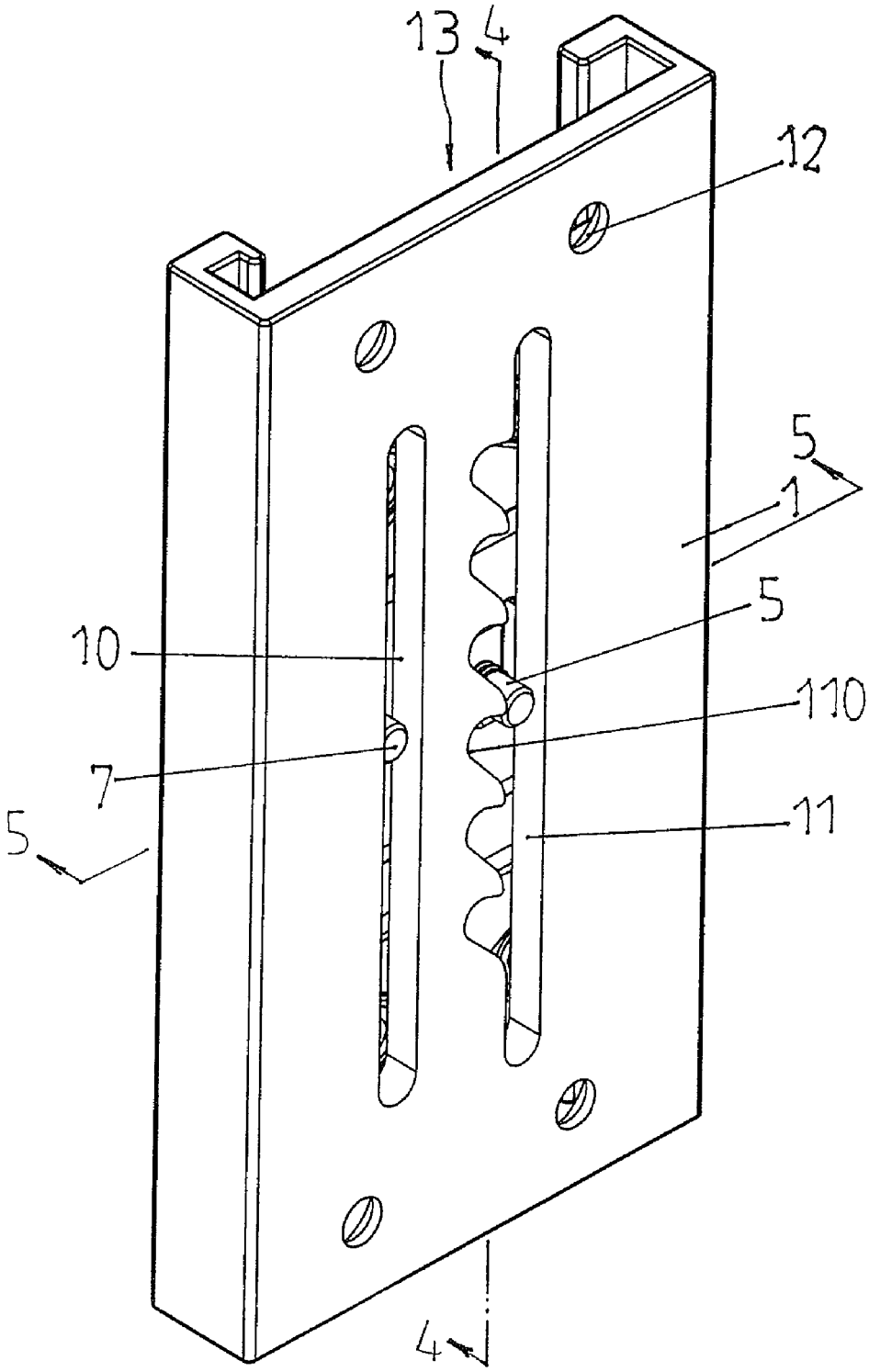
FIG. 1 is a perspective view of a lifting device in accordance with the preferred embodiment of the present invention.
Figure 2:
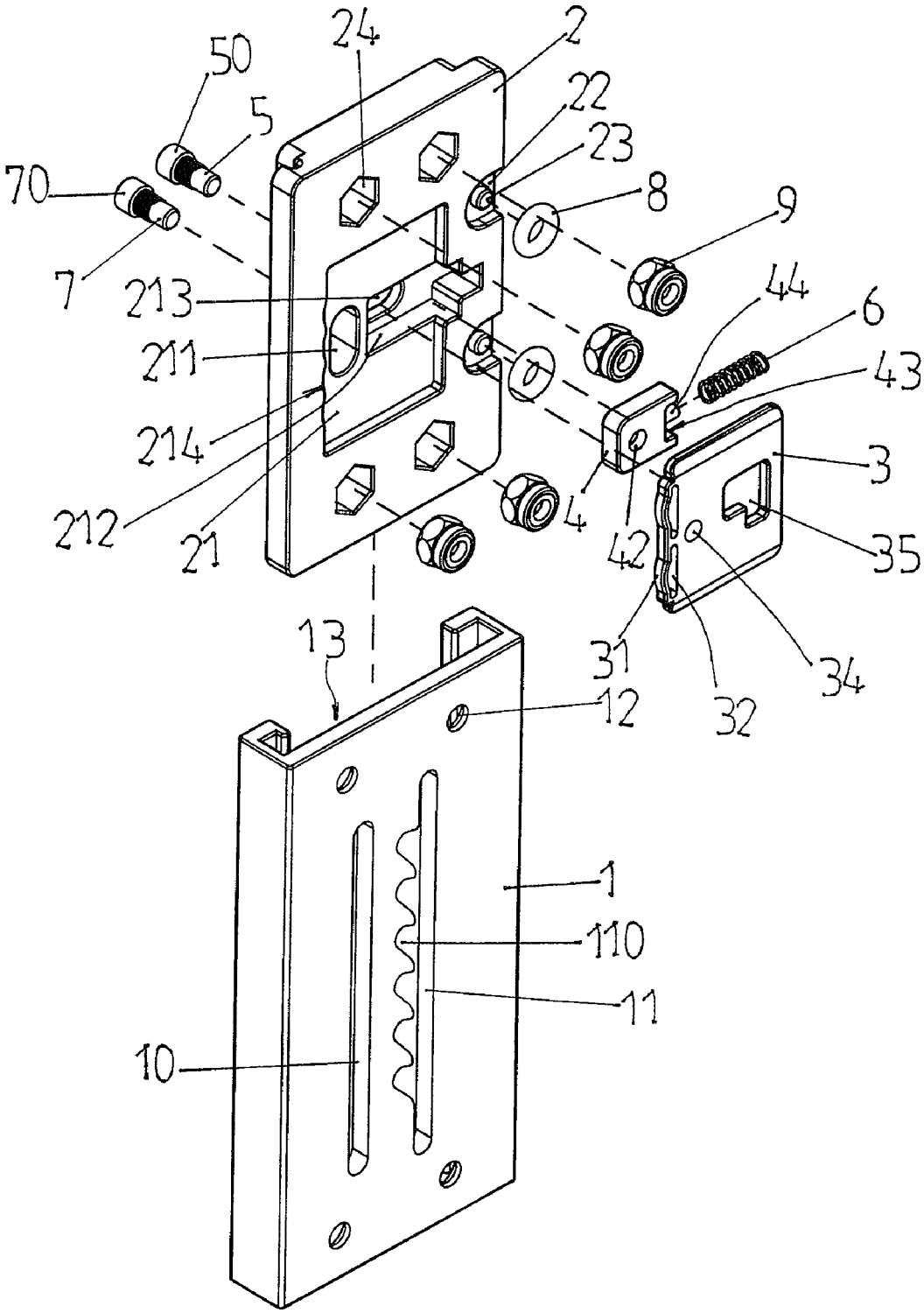
FIG. 2 is an exploded perspective view of the lifting device as shown in FIG. 1.
Figure 3:
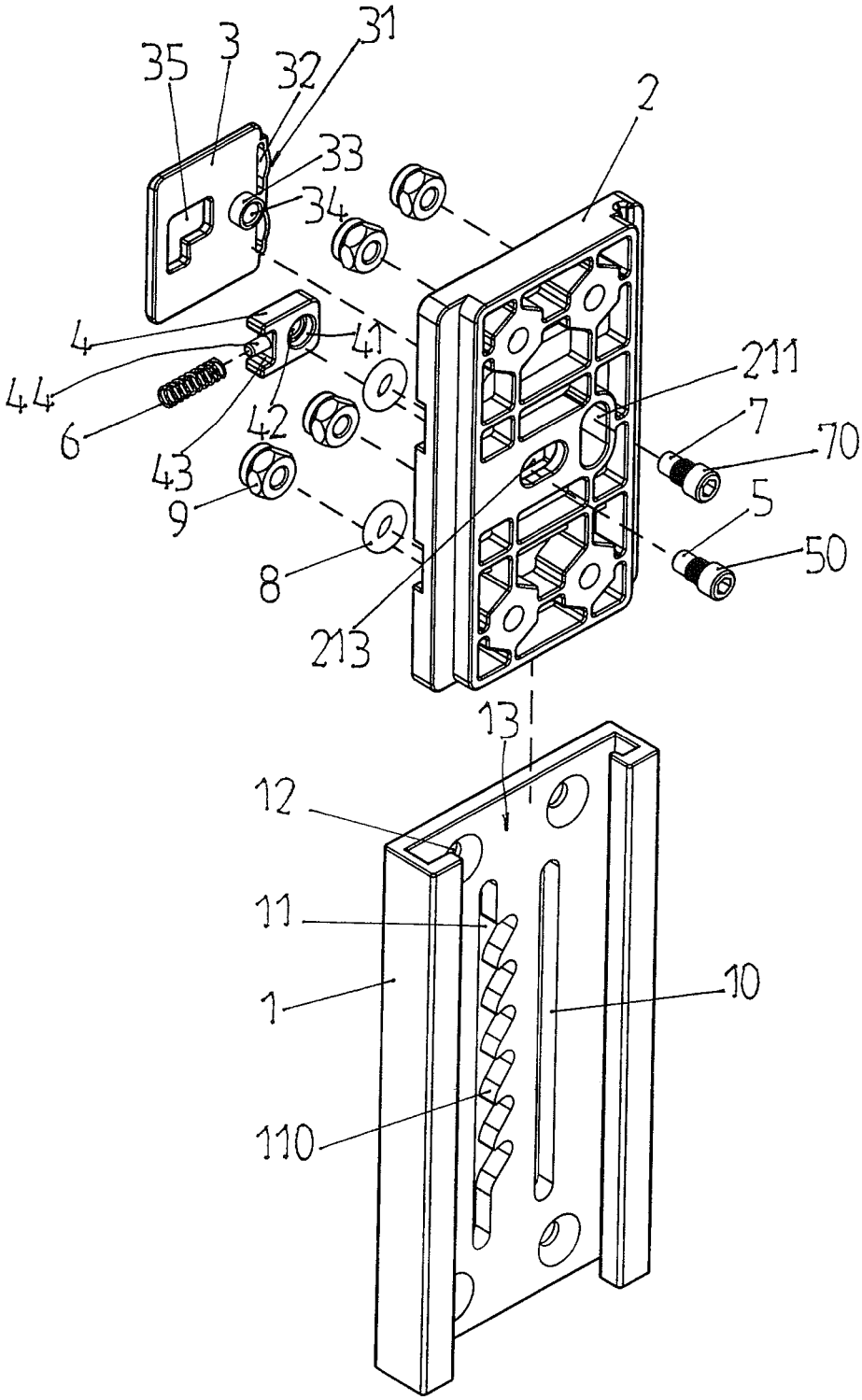
FIG. 3 is an exploded perspective view of the lifting device as shown in FIG. 1.
Figure 4:
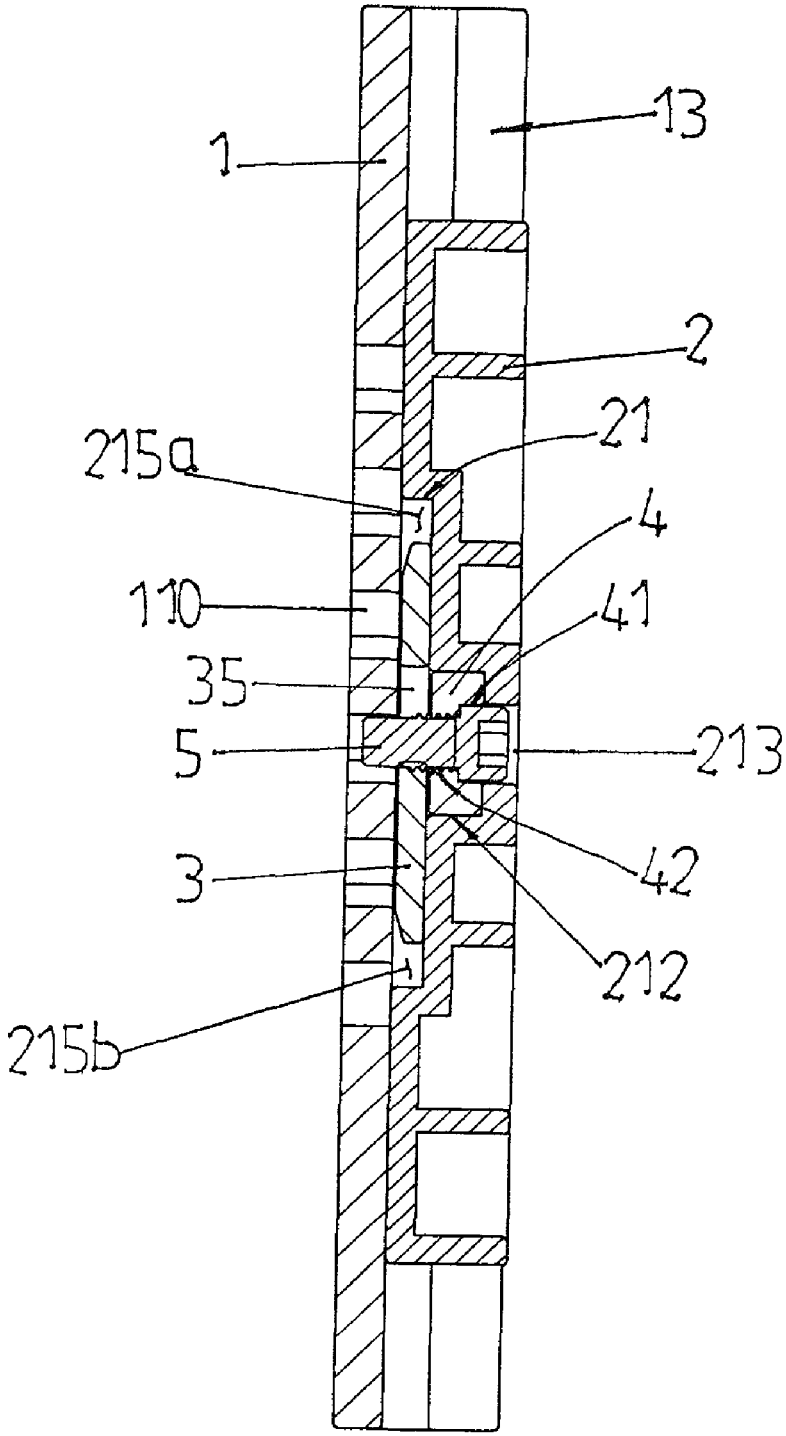
FIG. 4 is a cross-sectional view of the lifting device taken along line 4-4 as shown in FIG. 1.
Figure 5:
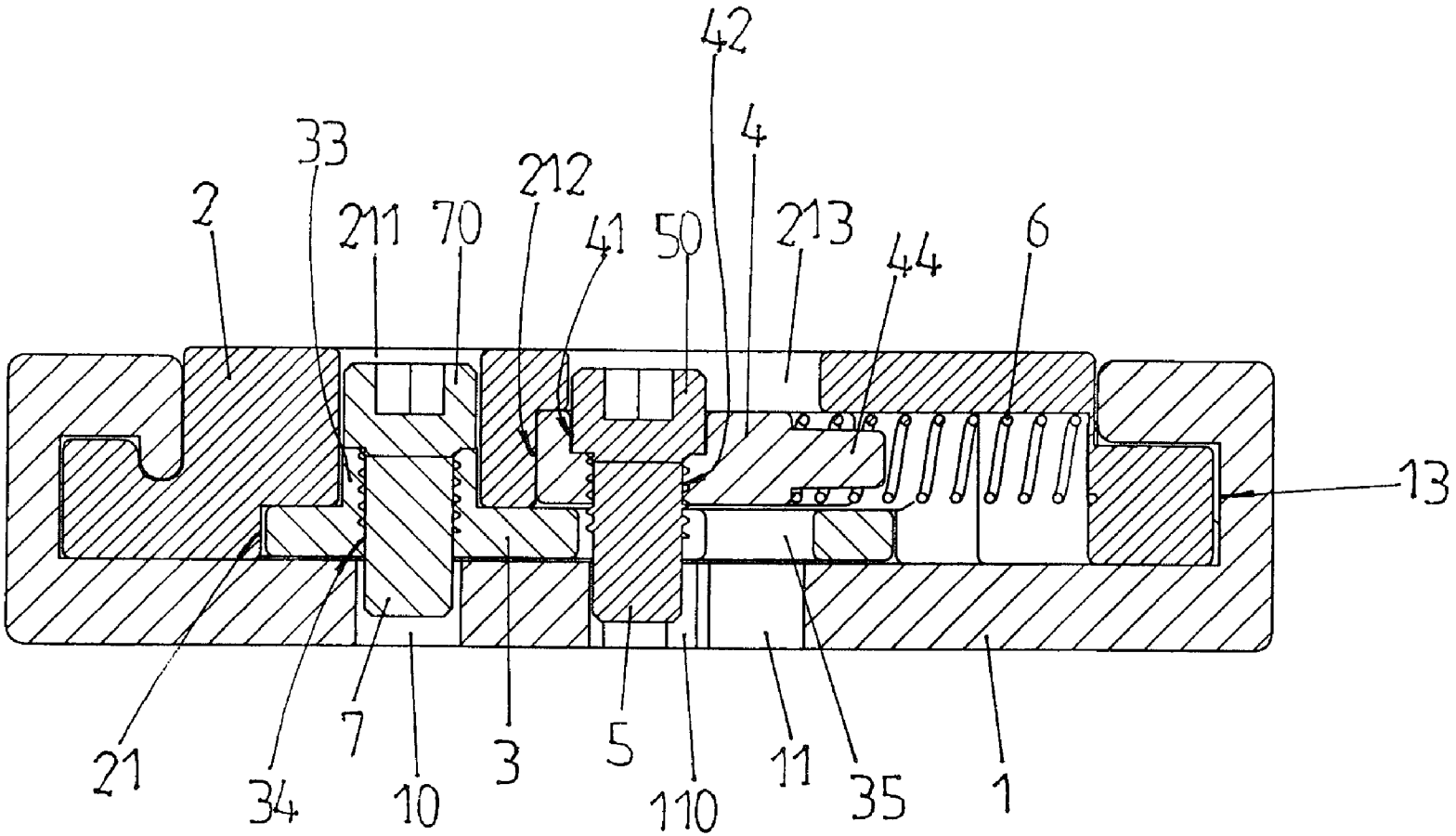
FIG. 5 is a cross-sectional view of the lifting device taken along line 5-5 as shown in FIG. 1.

Referring to the drawings and initially to FIGS. 1-7, a backrest lifting device for a chair in accordance with the preferred embodiment of the present invention comprises a fixed member 2, a movable member 1 movably mounted on the fixed member 2 and having an elongate slideway 11, a plurality of locking grooves 110 each connected to the slideway 11 and an elongate guide slot 10 parallel with the slideway 11, a locking bolt 5 extending into the slideway 11 of the movable member 1 and detachably locked in one of the locking grooves 110 of the movable member 1, a slide 4 slidably mounted on the fixed member 2 and secured on the locking bolt 5 to move the locking bolt 5 relative to the movable member 1, an elastic member 6 biased between the slide 4 and the fixed member 2 to push the slide 4 and the locking bolt 5 toward one of the locking grooves 110 of the movable member 1, a limit bolt 7 movably mounted on the fixed member 2 and extending into the guide slot 10 of the movable member 1, a positioning member 3 secured on the limit bolt 7 to move in concert with the limit bolt 7 and having a substantially inverted L-shaped locking slot 35 that is movable to detachably lock the locking bolt 5, and at least one roller 8 rotatably mounted on the fixed member 2 and slidably abutting the movable member 1 to facilitate movement of the movable member 1 relative to the fixed member 2.

The movable member 1 has an inner portion provided with a sliding track 13 slidably mounted on the fixed member 2. The sliding track 13 of the movable member 1 is connected to the guide slot 10, the slideway 11 and the locking grooves 110. Each of the locking grooves 110 of the movable member 1 has an oblique arcuate shape. The movable member 1 has a periphery provided with a plurality of fixing holes 12 for attaching the movable member 1 to the backrest "A" (see FIG. 7) of the chair.

The fixed member 2 is attached to a backrest support "B" (see FIG. 7) of a chair. The fixed member 2 is received in the sliding track 13 of the movable member 1 and has a surface provided with an upright receiving recess 21 to receive and allow movement of the positioning member 3. The receiving recess 21 of the fixed member 2 has a rectangular shape and has a sidewall provided with a corrugated first contact face 214. The receiving recess 21 of the fixed member 2 has a surface provided with an upright slot 211 and a transverse receiving space 212. The upright slot 211 of the fixed member 2 has an oblong shape. The receiving space 212 of the fixed member 2 has a surface provided with a transverse slot 213. The transverse slot 213 of the fixed member 2 has an oblong shape. The fixed member 2 has a periphery provided with a plurality of hexagonal receiving cavities 24 to receive a plurality of nuts 9 for attaching the fixed member 2 to the backrest support "B" of the chair. The fixed member 2 has a side provided with at least one opening 22 and at least one fixing post 23 located in the opening 22.

The positioning member 3 is located between the fixed member 2 and the movable member 1. The positioning member 3 has a rectangular shape and is movably mounted on the fixed member 2. The positioning member 3 is movable in the receiving recess 21 of the fixed member 2 so that an upper clearance 215*a* (see FIG. 6) is defined between an upper end of the positioning member 3 and an upper end of the receiving recess 21 and a lower clearance 215*b* (see FIG. 6) is defined between a lower end of the positioning member 3 and a lower end of the receiving recess 21. The positioning member 3 has an end portion provided with a corrugated second contact face 31 slidably contacting with the first contact face 214 of the fixed member 2. A buffering space 32 is defined between the positioning member 3 and the second contact face 31 to make the second contact face 31 flexible. The positioning member 3 has a screw hole 34 to allow passage of the limit bolt 7. The screw hole 34 of the positioning member 3 has a surface provided with a protruding plug 33 inserted into the upright slot 211 of the fixed member 2 and abutting a bolt head 70 of the limit bolt 7 to stop the limit bolt 7.

The slide 4 is slidable in the receiving space 212 of the fixed member 2. The slide 4 has a screw bore 42 to allow passage of the locking bolt 5. The screw bore 42 of the slide 4 has a side provided with an enlarged stop hole 41 to stop a bolt head 50 of the locking bolt 5. The slide 4 has an end portion provided with a mounting recess 43 and a fixing rod 44 located in the mounting recess 43.

The locking bolt 5 is slidably mounted on the fixed member 2 and is slidable in the transverse slot 213 of the fixed member 2. The locking bolt 5 is screwed into the screw bore 42 of the slide 4. The locking bolt 5 extends through the screw bore 42 of the slide 4 and the locking slot 35 of the positioning member 3 into the slideway 11 of the movable member 1. The locking bolt 5 is movable in the locking slot 35 of the positioning member 3 when the locking bolt 5 is unlocked from the locking slot 35 of the positioning member 3.

The limit bolt 7 is slidable in the upright slot 211 of the fixed member 2 and is screwed into the screw hole 34 of the positioning member 3. The limit bolt 7 extends through the screw hole 34 of the positioning member 3 into the guide slot 10 of the movable member 1.

The elastic member 6 is received in the receiving space 212 of the fixed member 2. The elastic member 6 has a first end received in the mounting recess 43 of the slide 4 and mounted on the fixing rod 44 of the slide 4 and a second and abutting a wall of the receiving space 212 of the fixed member 2.

The roller 8 is received in the opening 22 of the fixed member 2 and rotatably mounted on the fixing post 23 of the fixed member 2.

Figure 6:
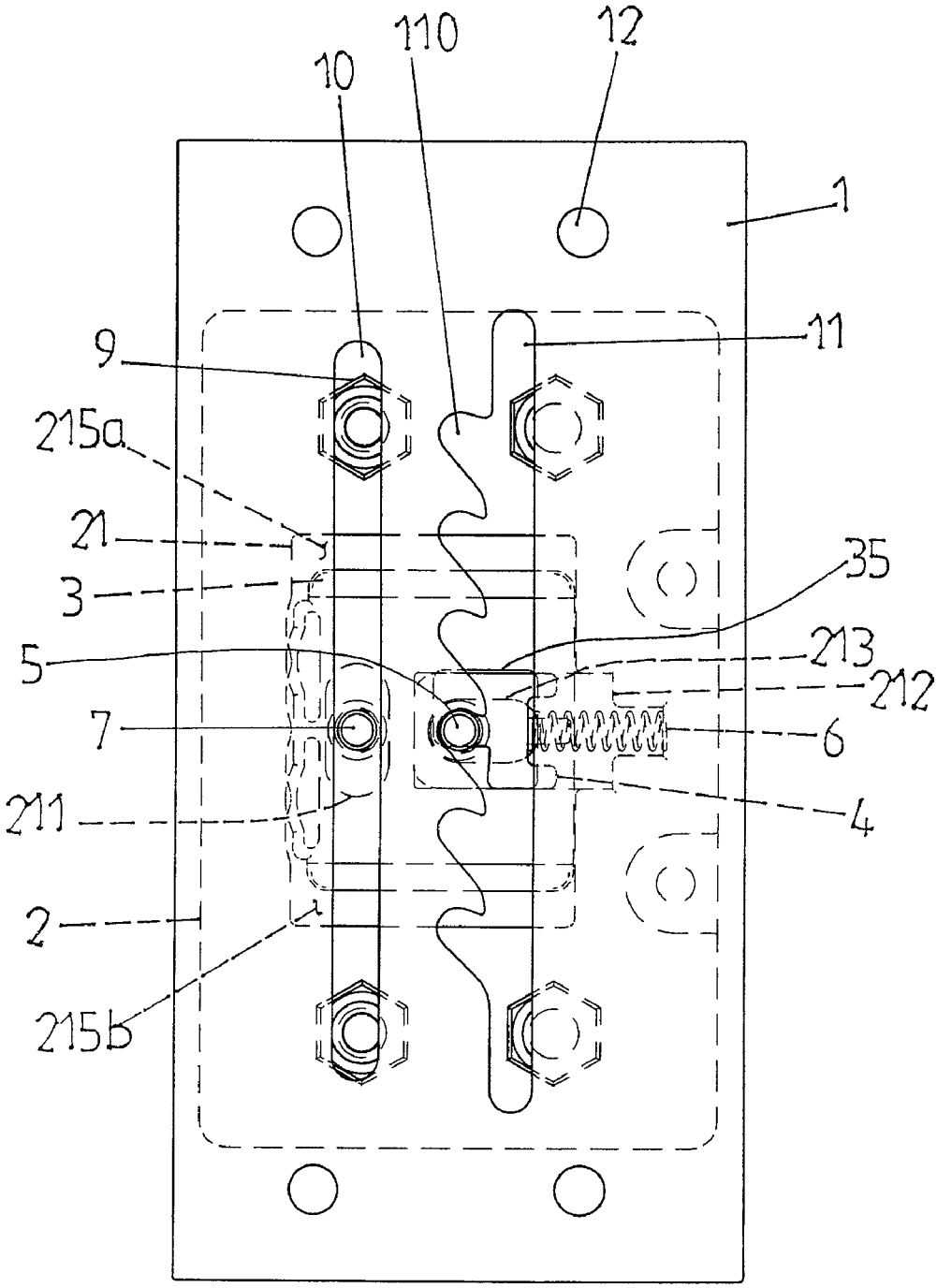
FIG. 6 is a front view of the lifting device as shown in FIG. 1.
Figure 7:
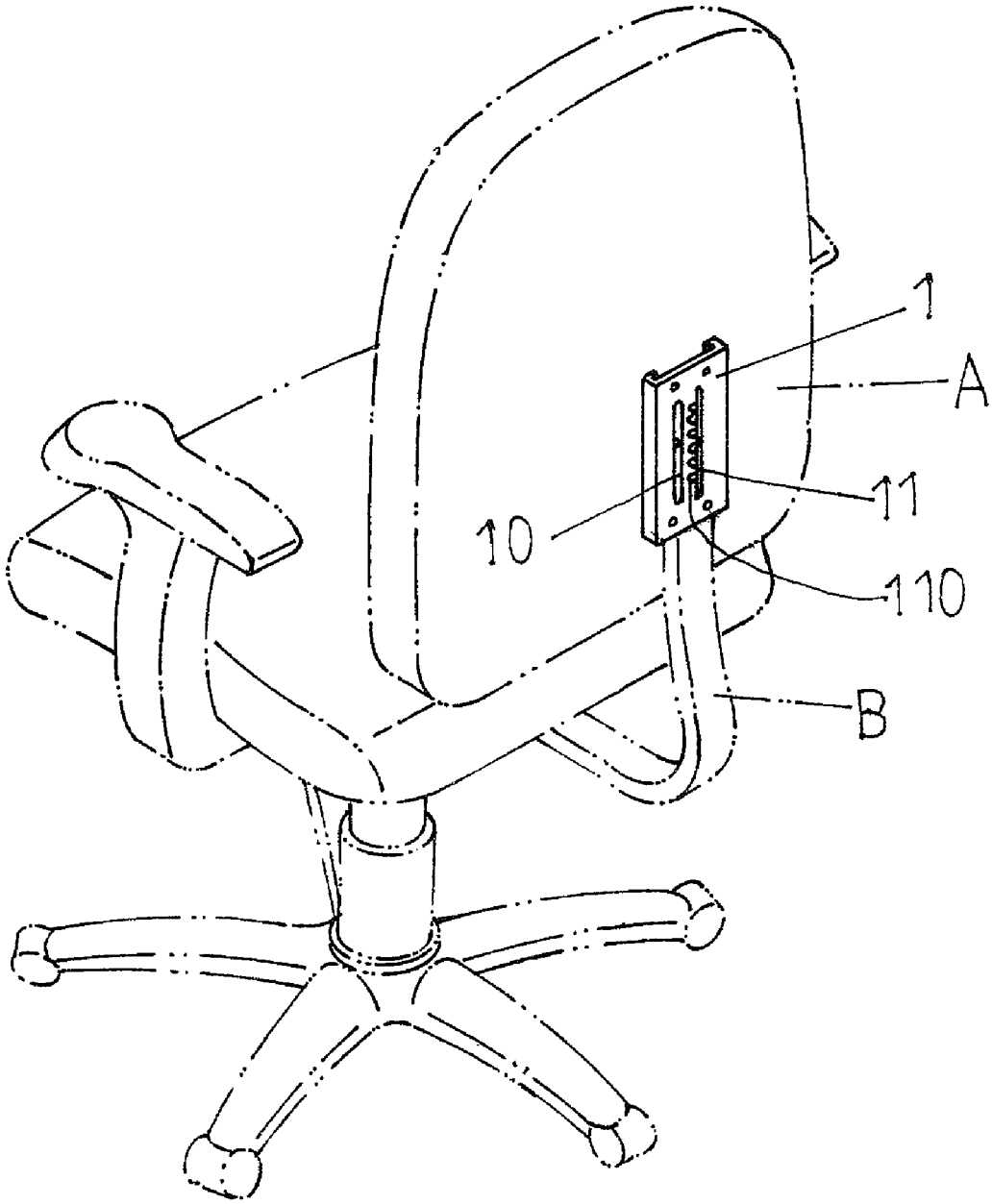
FIG. 7 is a perspective view showing the lifting device for a chair.

In operation, referring to FIGS. 6-14 with reference to FIGS. 1-5, the fixed member 2 is secured on the backrest support "B" of the chair, and the movable member 1 is secured on the backrest "A" of the chair as shown in FIG. 7.

As shown in FIG. 6, the locking bolt 5 is pushed toward the locking grooves 110 of the movable member 1 by the elastic member 6 so that the locking bolt 5 is inserted into and locked in one of the locking grooves 110 of the movable member 1 so as to lock the movable member 1 onto the fixed member 2. At this time, the locking bolt 5 is located at the leftmost position of the transverse slot 213 of the fixed member 2, the limit bolt 7 is located at the middle position of the upright slot 211 of the fixed member 2, and the positioning member 3 is located at the middle position of the receiving recess 21 of the fixed member 2.

When the movable member 1 is pulled and moved upward relative to the fixed member 2, the locking bolt 5 is pressed rightward by the wall defining the locking grooves 110 of the movable member 1 so that the locking bolt 5 is detached from one of the locking grooves 110 of the movable member 1 and extended into the slideway 11 of the movable member 1. At this time, the elastic member 6 is compressed by the slide 4 during movement of the locking bolt 5. When the movable member 1 is further pulled and moved upward relative to the fixed member 2, the locking bolt 5 is pushed toward the locking grooves 110 of the movable member 1 by the restoring force of the elastic member 6 so that the locking bolt 5 is inserted into and locked in another one of the locking grooves 110 of the movable member 1. In such a manner, the movable member 1 is pulled and moved upward relative to the fixed member 2 successively so as to adjust the height of the backrest "A" of the chair.

Figure 8:
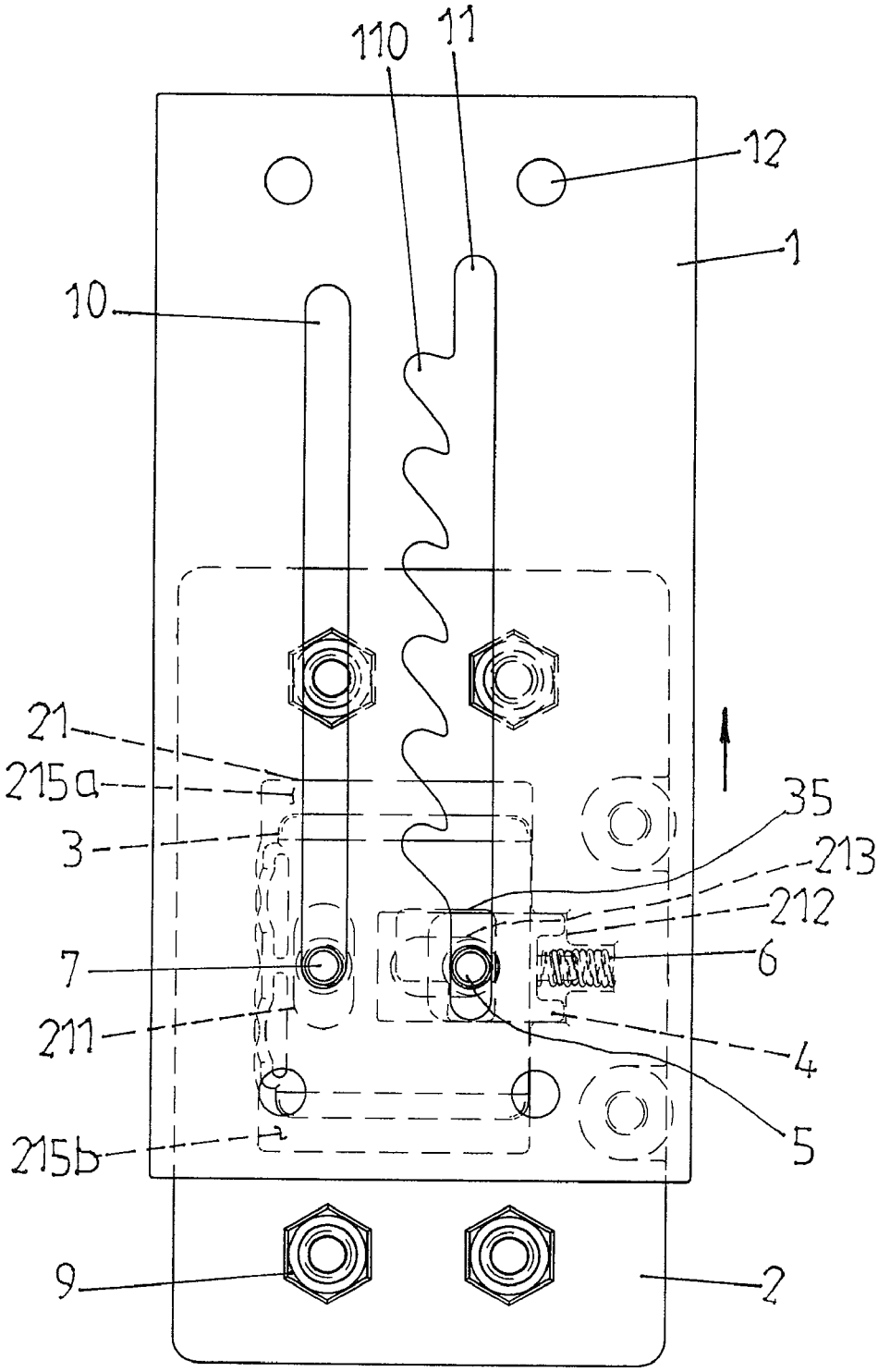
FIG. 8 is a schematic operational view of the lifting device as shown in FIG. 6.

As shown in FIG. 8, when the movable member 1 is further pulled and moved upward relative to the fixed member 2 until the bottom of the guide slot 10 of the movable member 1 abuts the limit bolt 7, the locking bolt 5 is detached from each of the locking grooves 110 of the movable member 1 and extended into the slideway 11 of the movable member 1. At this time, the locking bolt 5 is pressed rightward by the wall defining the slideway 11 of the movable member 1 so that the locking bolt 5 is moved to the rightmost position of the transverse slot 213 of the fixed member 2. In addition, the upper clearance 215*a* is defined between the upper end of the positioning member 3 and the upper end of the receiving recess 21.

Figure 9:
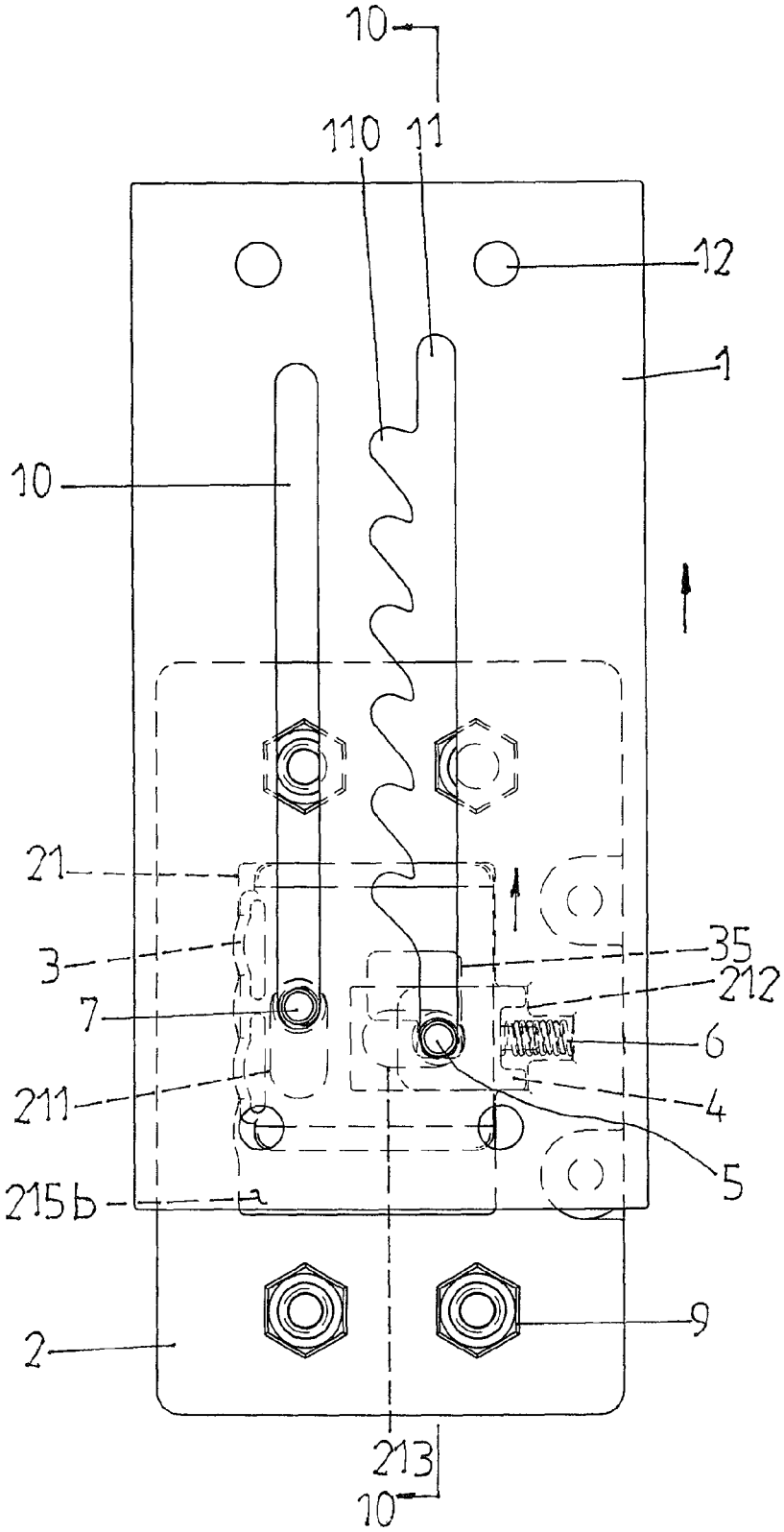
FIG. 9 is a schematic operational view of the lifting device as shown in FIG. 8.
Figure 10:
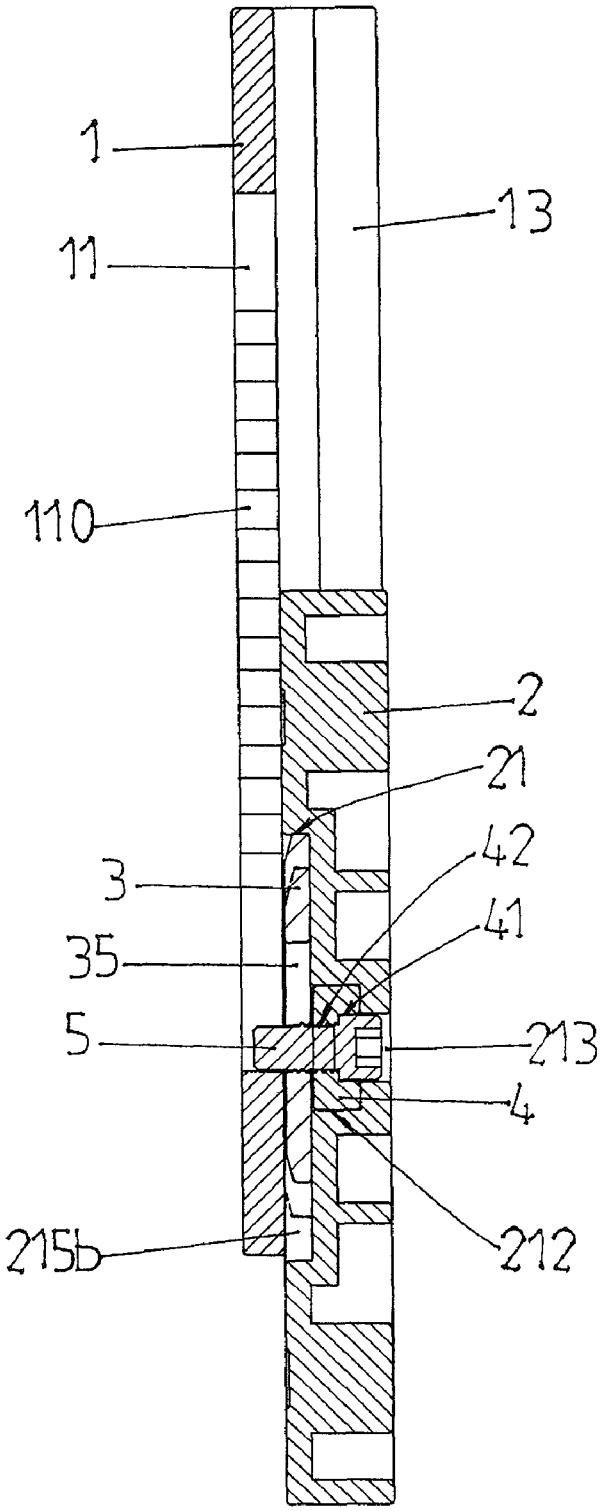
FIG. 10 is a schematic operational view of the lifting device as shown in FIG. 4.

As shown in FIGS. 9 and 10, when the limit bolt 7 is pushed upward by the bottom of the guide slot 10 of the movable member 1, the positioning member 3 is pushed upward by the limit bolt 7 such that the upper end of the positioning member 3 abuts the upper end of the receiving recess 21 as shown in FIG. 10, and the locking slot 35 of the positioning member 3 is moved upward such that the bottom of the locking slot 35 abuts the locking bolt 5 as shown in FIG. 9 so as to lock the locking bolt 5 by the locking slot 35 of the positioning member 3. At this time, the locking bolt 5 is located at the bottom of the slideway 11 of the movable member 1. In addition, the locking bolt 5 is located at the rightmost position of the transverse slot 213 of the fixed member 2, the elastic member 6 is compressed, and the limit bolt 7 is located at the top of the upright slot 211 of the fixed member 2.

As shown in FIG. 9, when the locking bolt 5 is locked by the locking slot 35 of the positioning member 3, the locking bolt 5 will not be moved toward the locking grooves 110 of the movable member 1 by the elastic member 6. At this time, the locking bolt 5 is located at the rightmost position of the transverse slot 213 of the fixed member 2, so that the locking bolt 5 is detached from each of the locking grooves 110 of the movable member 1 constantly.

Figure 11:
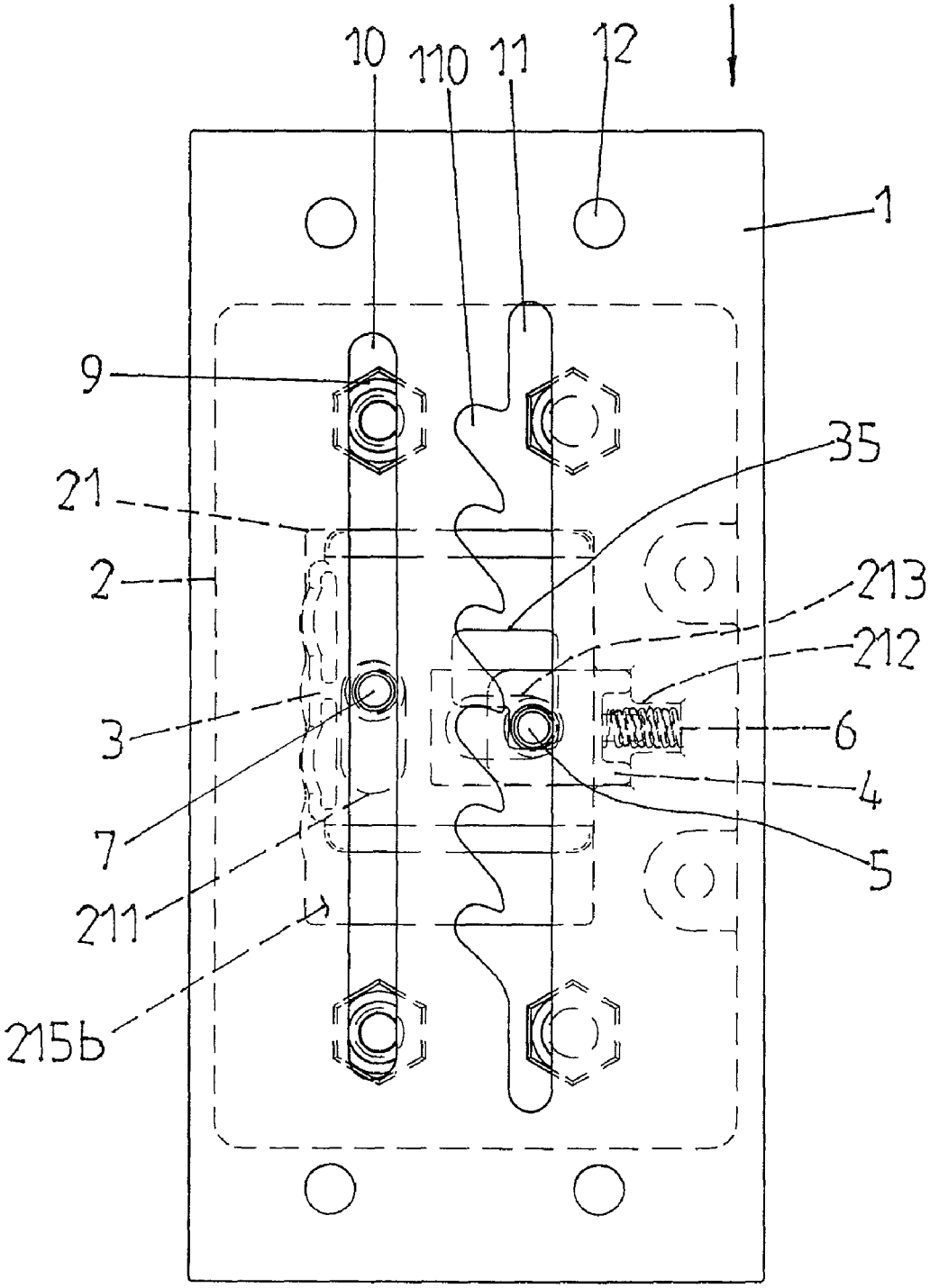
FIG. 11 is a schematic operational view of the lifting device as shown in FIG. 9.

As shown in FIG. 11, the locking bolt 5 is locked by the locking slot 35 of the positioning member 3 and is detached from each of the locking grooves 110 of the movable member 1 so that the movable member 1 is pushed and moved downward relative to the fixed member 2 freely.

Figure 12:
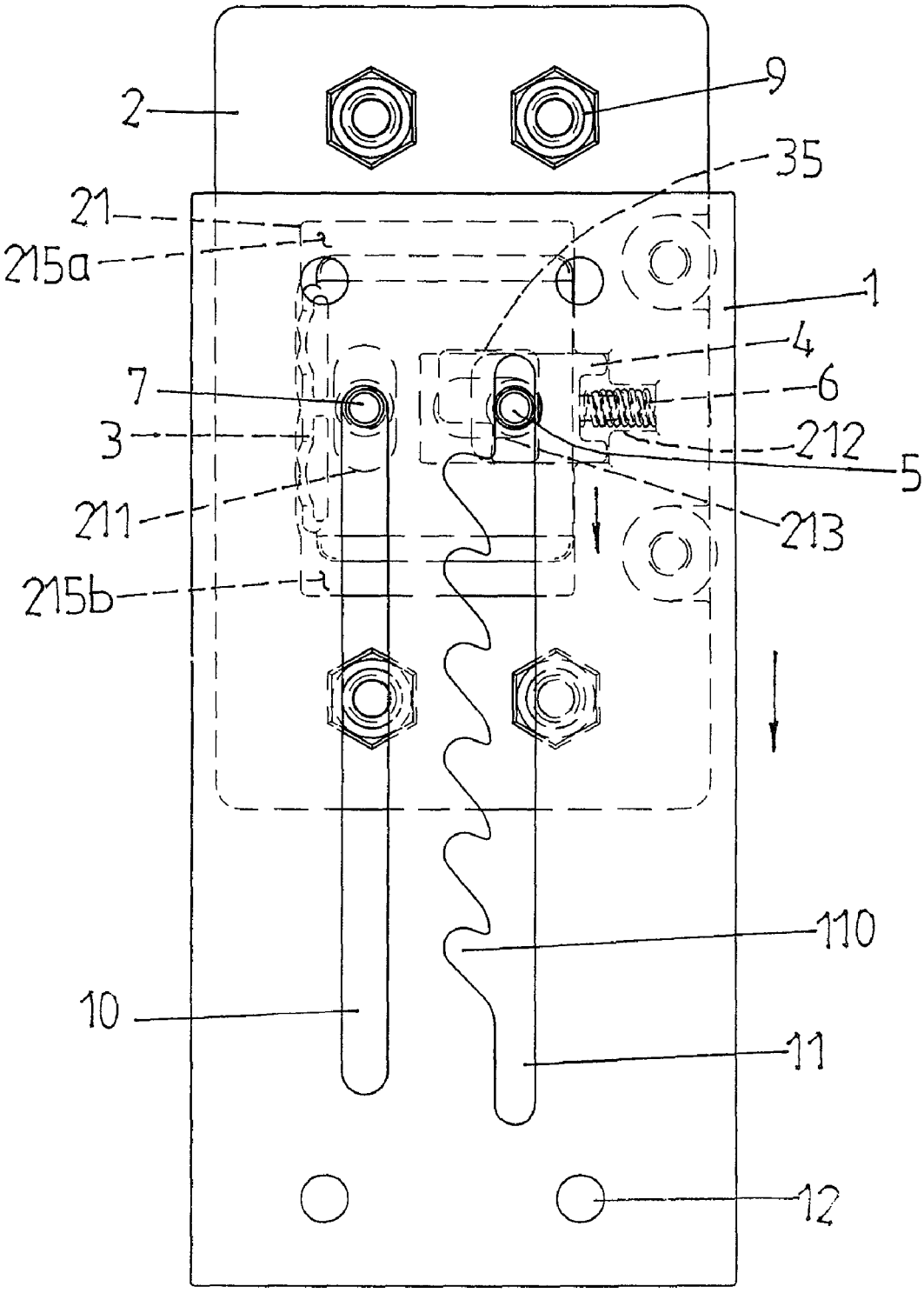
FIG. 12 is a schematic operational view of the lifting device as shown in FIG. 11.

As shown in FIG. 12, when the movable member 1 is further pushed and moved downward relative to the fixed member 2 until the top of the guide slot 10 of the movable member 1 abuts the limit bolt 7, the limit bolt 7 is pushed downward by the top of the guide slot 10 of the movable member 1 so that the positioning member 3 is moved downward by the limit bolt 7 until the upper clearance 215*a* is defined between the upper end of the positioning member 3 and the upper end of the receiving recess 21, while the locking slot 35 of the positioning member 3 is moved downward relative to the locking bolt 5. At this time, the lower clearance 215*b* is defined between the lower end of the positioning member 3 and the lower end of the receiving recess 21.

Figure 13:
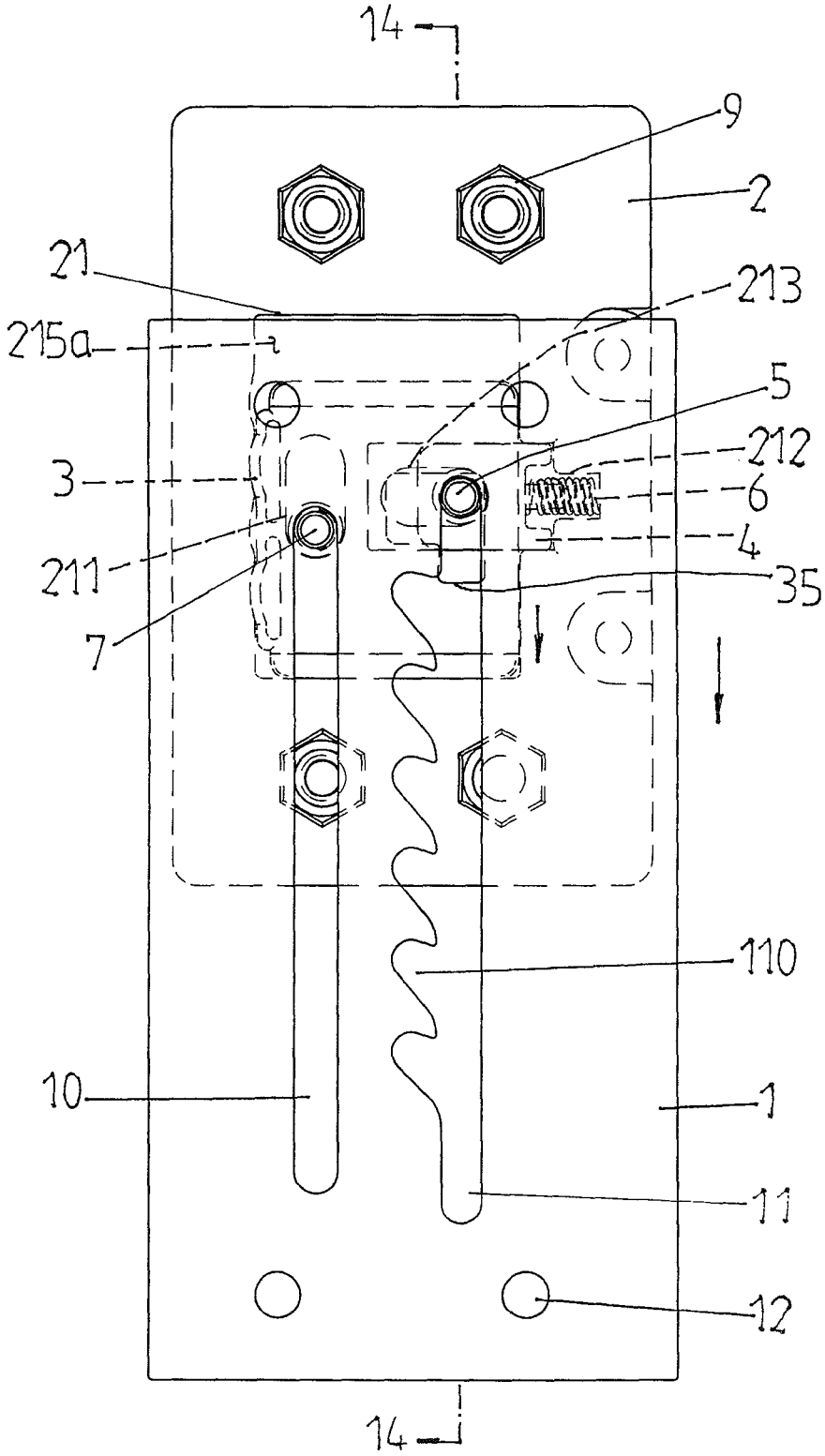
FIG. 13 is a schematic operational view of the lifting device as shown in FIG. 12.
Figure 14:
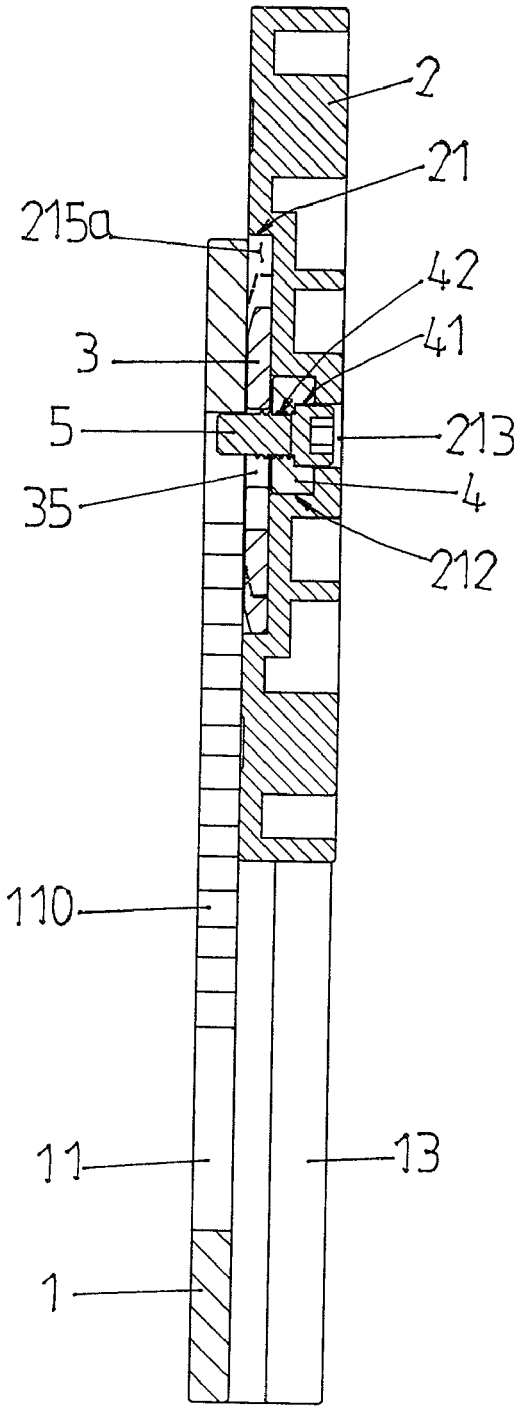
FIG. 14 is a schematic operational view of the lifting device as shown in FIG. 10.

As shown in FIGS. 13 and 14, when the movable member 1 is further pushed and moved downward relative to the fixed member 2, the positioning member 3 is moved downward by the limit bolt 7 until the lower end of the positioning member 3 abuts the lower end of the receiving recess 21, and the locking slot 35 of the positioning member 3 is further moved downward relative to the locking bolt 5 until the locking bolt 5 is extended into the top of the locking slot 35 so that the locking bolt 5 is unlocked from and is movable in the locking slot 35 of the positioning member 3. At this time, the locking bolt 5 is located at the top of the slideway 11 of the movable member 1. In addition, the locking bolt 5 is located at the rightmost position of the transverse slot 213 of the fixed member 2, the elastic member 6 is compressed, and the limit bolt 7 is located at the bottom of the upright slot 211 of the fixed member 2.

In such a manner, when the movable member 1 is pulled and moved upward relative to the fixed member 2, the locking bolt 5 is pushed toward the locking grooves 110 of the movable member 1 by the restoring force of the elastic member 6 so that the locking bolt 5 is inserted into and locked in one of the locking grooves 110 of the movable member 1 as shown in FIG. 6 so as to lock the movable member 1 onto the fixed member 2.

Accordingly, the movable member 1 is moved relative to the fixed member 2 to adjust the height of the backrest "A" of the chair so that the height of the backrest "A" can be adjusted according to a user's requirement, and the backrest "A" can support the user's back efficiently, thereby providing a comfortable sensation to the user. In addition, the at least one roller 8 is rotatably mounted between the fixed member 2 and the movable member 1 to facilitate movement of the movable member 1 relative to the fixed member 2. Further, the positioning member 3 has a corrugated second contact face 31 slidably contacting with the corrugated first contact face 214 of the fixed member 2, and a buffering space 32 is defined between the positioning member 3 and the second contact face 31 so as to facilitate movement of the positioning member 3 relative to the fixed member 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lifting device, comprising:

a fixed member;

a movable member movably mounted on the fixed member and having an elongate slideway, a plurality of locking grooves each connected to the slideway and an elongate guide slot parallel with the slideway;

a locking bolt extending into the slideway of the movable member and detachably locked in one of the locking grooves of the movable member;

a slide slidably mounted on the fixed member and secured on the locking bolt to move the locking bolt relative to the movable member;

an elastic member biased between the slide and the fixed member to push the slide and the locking bolt toward one of the locking grooves of the movable member;

a limit bolt movably mounted on the fixed member and extending into the guide slot of the movable member;

a positioning member secured on the limit bolt to move in concert with the limit bolt and having a substantially inverted L-shaped locking slot that is movable to detachably lock the locking bolt;

wherein the fixed member has a surface provided with an upright receiving recess to receive and allow movement of the positioning member;

the receiving recess of the fixed member has a sidewall provided with a corrugated first contact face;

the positioning member has an end portion provided with a corrugated second contact face slidably contacting with the first contact face of the fixed member.

2. The lifting device of claim 1, wherein the movable member has an inner portion provided with a sliding track slidably mounted on the fixed member;

the fixed member is received in the sliding track of the movable member.

3. The lifting device of claim 2, wherein the sliding track of the movable member is connected to the guide slot, the slideway and the locking grooves;

each of the locking grooves of the movable member has an oblique arcuate shape;

the positioning member is located between the fixed member and the movable member.

4. The lifting device of claim 1, wherein the positioning member is movable in the receiving recess of the fixed member;

an upper clearance is defined between an upper end of the positioning member and an upper end of the receiving recess;

a lower clearance is defined between a lower end of the positioning member and a lower end of the receiving recess.

5. The lifting device of claim 1, wherein a buffering space is defined between the positioning member and the second contact face to make the second contact face flexible.

6. The lifting device of claim 1, wherein the movable member has a periphery provided with a plurality of fixing holes.

7. The lifting device of claim 1, wherein the fixed member has a periphery provided with a plurality of hexagonal receiving cavities to receive a plurality of nuts.

8. The lifting device of claim 1, wherein the movable member and the positioning member are movable upward relative to the locking bolt to a position where a bottom of the locking slot abuts the locking bolt to lock the locking bolt, and the locking bolt is located at a bottom of the slideway of the movable member.

9. A lifting device, comprising:

a fixed member;

a movable member movably mounted on the fixed member and having an elongate slideway, a plurality of locking grooves each connected to the slideway and an elongate guide slot parallel with the slideway;

a locking bolt extending into the slideway of the movable member and detachably locked in one of the locking grooves of the movable member;

a slide slidably mounted on the fixed member and secured on the locking bolt to move the locking bolt relative to the movable member;

an elastic member biased between the slide and the fixed member to push the slide and the locking bolt toward one of the locking grooves of the movable member;

a limit bolt movably mounted on the fixed member and extending into the guide slot of the movable member;

a positioning member secured on the limit bolt to move in concert with the limit bolt and having a substantially inverted L-shaped locking slot that is movable to detachably lock the locking bolt;

wherein the fixed member has a surface provided with an upright receiving recess to receive and allow movement of the positioning member;

the receiving recess of the fixed member has a surface provided with an upright slot and a transverse receiving space;

the receiving space of the fixed member has a surface provided with a transverse slot;

the slide is slidable in the receiving space of the fixed member;

the locking bolt is slidably mounted on the fixed member and is slidable in the transverse slot of the fixed member;

the limit bolt is slidable in the upright slot of the fixed member.

10. The lifting device of claim 9, wherein the positioning member has a screw hole to allow passage of the limit bolt;

the limit bolt is screwed into the screw hole of the positioning member;

the limit bolt extends through the screw hole of the positioning member into the guide slot of the movable member.

11. The lifting device of claim 10, wherein the screw hole of the positioning member has a surface provided with a protruding plug inserted into the upright slot of the fixed member and abutting a bolt head of the limit bolt to stop the limit bolt.

12. The lifting device of claim 9, wherein the slide has a screw bore to allow passage of the locking bolt;

the locking bolt is screwed into the screw bore of the slide;

the locking bolt extends through the screw bore of the slide and the locking slot of the positioning member into the slideway of the movable member;

the locking bolt is movable in the locking slot of the positioning member when the locking bolt is unlocked from the locking slot of the positioning member.

13. The lifting device of claim 12, wherein the screw bore of the slide has a side provided with an enlarged stop hole to stop a bolt head of the locking bolt.

14. The lifting device of claim 9, wherein the slide has an end portion provided with a mounting recess and a fixing rod located in the mounting recess;

the elastic member is received in the receiving space of the fixed member;

the elastic member has a first end received in the mounting recess of the slide and mounted on the fixing rod of the slide and a second and abutting a wall of the receiving space of the fixed member.

15. The lifting device of claim 9, wherein the receiving recess of the fixed member has a rectangular shape;

the positioning member has a rectangular shape;

the upright slot of the fixed member has an oblong shape;

the transverse slot of the fixed member has an oblong shape.

16. A lifting device, comprising:

a fixed member;

a movable member movably mounted on the fixed member and having an elongate slideway, a plurality of locking grooves each connected to the slideway and an elongate guide slot parallel with the slideway;

a locking bolt extending into the slideway of the movable member and detachably locked in one of the locking grooves of the movable member;

a slide slidably mounted on the fixed member and secured on the locking bolt to move the locking bolt relative to the movable member;

an elastic member biased between the slide and the fixed member to push the slide and the locking bolt toward one of the locking grooves of the movable member;

a limit bolt movably mounted on the fixed member and extending into the guide slot of the movable member;

at least one roller rotatably mounted on the fixed member and slidably abutting the movable member to facilitate movement of the movable member relative to the fixed member;

the fixed member has a side provided with at least one opening and at least one fixing post located in the opening;

the at least one roller is received in the opening of the fixed member and rotatably mounted on the fixing post of the fixed member.

* * * * *